US006378612B1

(12) United States Patent
Churchill

(10) Patent No.: US 6,378,612 B1
(45) Date of Patent: Apr. 30, 2002

(54) PRESSURE ACTUATED DOWNHOLE TOOL

(76) Inventor: Andrew Philip Churchill, 11 McDonald Drive, Ellon, Aberdeenshire, AB41 3BD, Scotland (GB)

( * ) Notice: Subject to any disclaimer, the term of this patent is extended or adjusted under 35 U.S.C. 154(b) by 0 days.

(21) Appl. No.: 09/646,196

(22) PCT Filed: Mar. 12, 1999

(86) PCT No.: PCT/GB99/00754

§ 371 Date: Sep. 14, 2000

§ 102(e) Date: Sep. 14, 2000

(87) PCT Pub. No.: WO99/47789

PCT Pub. Date: Sep. 23, 1999

(30) Foreign Application Priority Data

Mar. 14, 1998 (GB) ..... 9805413
Feb. 3, 1999 (GB) ..... 9902398

(51) Int. Cl.[7] ..... E21B 34/08
(52) U.S. Cl. ..... 166/319; 166/321; 166/374
(58) Field of Search ..... 166/373, 316, 166/319, 320, 321, 332.1, 334.4, 374

(56) References Cited

U.S. PATENT DOCUMENTS 4,377,179 A * 3/1983 Giebeler ..... 137/494
4,432,417 A * 2/1984 Bowyer ..... 166/120
4,624,311 A * 11/1986 Goad ..... 166/125
5,052,489 A * 10/1991 Carisella et al. ..... 166/297
5,947,205 A * 9/1999 Shy ..... 166/319

* cited by examiner

*Primary Examiner*—Frank Tsay
(74) *Attorney, Agent, or Firm*—Gifford, Krass, Groh, Sprinkle, Anderson & Citkowski, P.C.

(57) ABSTRACT

A downhole tool (20) comprises a body (22), a tool function member (28, 30) axially movable relative to the body (22) from an initial position to an operative position, a first spring (32) responsive to a first fluid pressure force for permitting movement of the tool function member (28) from the initial position to an intermediate position; and a second spring (33) responsive to a higher second fluid pressure force for selectively permitting movement of the tool function member (30) to the operative position. The tool function member may be in one or two parts and may include a bypass sleeve (30).

26 Claims, 13 Drawing Sheets

PRESSURE ACTUATED DOWNHOLE TOOL

FIELD OF THE INVENTION

This invention relates to a downhole tool, and in particular to a pressure actuated downhole tool, such as a bypass tool.

DESCRIPTION OF THE RELEVANT PRIOR ART

In production of hydrocarbons from subsurface formations, drilling operations are typically undertaken using a drill bit mounted on the lower end of a drill string formed of sections of drill pipe which are threaded together. The drill string is rotated from the surface, and drilling fluid or "mud" is pumped through the string, to exit at appropriate nozzles adjacent the drill bit. The mud carries the drill cuttings away from the drilling zone and up to the surface through the annulus defined between the bore wall and the drill string. In certain circumstances, such as in non-vertical bores, the drill cuttings may collect in a section of the bore, interfering with the drilling operation and creating problems when it is desired to remove the drill string from the bore.

To counter this difficulty, it is known to provide bypass tools in the drill string, which tools may be configured to allow drilling mud to pass directly from the drill string bore to the annulus, without circulating through the drill bit. A typical bypass tool defines ports in the tool body which are initially closed by an axially movable sleeve. However, the sleeve is mounted to the tool body such that elevated pressure, acting on a ball which has been dropped down the drill string to engage the sleeve, causes the sleeve to move and uncover the ports, allowing direct fluid communication between the string bore and the annulus. Most existing bypass tools cannot be re-closed after the sleeve has been moved to the open position and thus must be raised to the surface to allow resetting.

In a typical drilling operation, the pressure of the drilling mud will be subject to variations as, for example, new drill pipe sections are added to the string, such that a fluid bypass tool that incorporated a freely reciprocally movable pressure sensitive sleeve would be subject to continual opening and closing, which would prove inconvenient and create delays in the drilling operation: if the drilling operation necessitated that the bypass tool was closed, it might be necessary to cycle the drilling mud pressure to close the tool before the drilling operation could commence.

It is among the objectives of embodiments of the present invention to provide a pressure actuated bypass tool which obviates or mitigates this disadvantage.

It is a further objective of the present invention to provide a fluid pressure actuated downhole tool having a plurality of operative configurations.

SUMMARY OF THE INVENTION

According to the present invention there is provided a downhole tool, the tool comprising:

a body;

a fluid pressure actuated member axially movable relative to the body;

a tool function member which is not responsive to fluid pressure and is axially movable relative to the body to an operative position; and means for selectively coupling the fluid pressure actuated member to the tool function member to permit movement of said tool function member to the operative position on application of pressure to the fluid pressure actuated member.

According to another aspect of the present invention there is provided a method of remotely activating a downhole tool, the method comprising:

providing a downhole tool comprising a body, a fluid pressure actuated member axially movable relative to the body and a tool function member which is not responsive to fluid pressure and is axially movable relative to the body;

selectively coupling the fluid pressure actuated member to the tool function member;

applying fluid pressure to said fluid pressure actuated member to move the members axially relative to the body, thereby moving the tool function member to an operative position.

The provision of the selective coupling means between the fluid pressure actuated member and the tool function member permits the pressure in the tool to be varied or cycled without the tool functioning. Thus, in use, the pressure cycles which are typically encountered during the course of, for example, a drilling operation, will not necessarily result in functioning of the tool, which otherwise may create inconvenience and delay.

Preferably, in a first configuration said coupling means permits axial movement of the fluid pressure actuated member substantially independently of the tool function member, and in a second configuration axial movement of the fluid pressure actuated means may result in corresponding axial movement of the tool function member.

Preferably also, one or both of the fluid pressure actuated member and the tool function member are sleeves.

Preferably also, the body is tubular and defines a bore and in the operative position the tool function member permits fluid communication between the bore and the exterior of the body, that is the tool is a fluid bypass tool. In this embodiment, the tool function member may define apertures for selectively providing fluid communication with apertures defined in the body wall. Most preferably, the tool permits fluid bypass when the apertures are aligned. The fluid pressure actuated member may also define slots or apertures.

Preferably also, both of the fluid pressure actuated member and the tool function member are biassed towards a first position, most preferably by respective springs, and application of fluid pressure tends to move one or both of the members towards a second position against the action of the respective biassing member. Most preferably, the tool function member is biassed towards the first position by a biassing means which only permits movement of the member when the member is subject to a predetermined force from the fluid pressure actuated member.

Preferably also, the fluid pressure actuated member is flow responsive. Most preferably, the member defines a flow restriction such that flow of fluid through the body above a predetermined flowrate creates a pressure differential across the restriction sufficient to move the member axially relative to the body. In an alternative embodiment, the fluid pressure actuated member may be responsive to differential pressure between the tool interior and exterior.

In one embodiment, the coupling means comprises a track and follower arrangement configurable to restrict relative movement between the fluid pressure actuated member and the tool function member. The coupling means may further comprise an arrangement to selectively restrict movement of the fluid pressure actuated member on the tool function member relative to the body, which arrangement may comprise a further track and follower.

In another embodiment, the coupling means comprises a link or coupling between the fluid actuated member and the tool function member such that the movement of the fluid actuated member results in movement of the tool function member. The coupling may initially be in a non-coupling configuration allowing movement of the fluid actuated member independently of the tool function member: the coupling means may be controlled by a time sensitive actuator, which is adapted to move the coupling from a non-coupling configuration to a coupling configuration if, for example, the mud pumps are turned off and on within a predetermined interval or turned on, off and on within a predetermined interval, or indeed any sequence of mud pump activation and de-activation within a predetermined interval. Subsequently, the coupling may be returned to a non-coupling configuration. In other embodiments, the coupling means may be controlled by pressure pulses, radio signals, electrical signals or other forms of signals transmitted from the surface.

According to a further aspect of the present invention there is provided a downhole tool, the tool comprising:

a body;

a tool function member axially movable relative to the body from an initial position to an operative position;

first means responsive to a first force for permitting movement of the tool function member from the initial position to an intermediate position; and second means responsive to a higher second force for selectively permitting movement of the tool function member from the initial position to the operative position.

This aspect of the present invention fluid provides a tool having at least three possible configurations. Embodiments of the invention may include three or more means, with a corresponding increase in the number of available intermediate positions, some or all of which may serve a function.

Preferably, the tool function member is fluid pressure actuated and the first means is responsive to a first fluid pressure force and the second means is responsive to a higher second fluid pressure force. The fluid pressure forces are preferably flow induced. The tool function member may be operatively associated with a flow restriction, which flow restriction may be fixed, or may be variable.

Preferably also, the first and second means are two or more springs, for example a pair of springs, a lower rated first spring permitting movement of the member to the intermediate position and a higher rated or pre-tensioned second spring which only permits movement to the operative position, or an alternative intermediate position, on application of the higher second fluid pressure force. In this manner the tool may, for example, be cycled while experiencing a lower first fluid pressure force without the tool function member becoming operative, and only when the tool experiences the higher second fluid pressure force does the tool function member become operative.

The tool function member may be a single member, such as a sleeve, or may be in two or more parts, coupled by appropriate means for selectively coupling the parts.

Preferably also, the tool function member defines a through bore.

The tool may be a fluid bypass tool, and in the operative position the tool function member permits fluid flow from the tool bore to a surrounding annulus.

According to another aspect of the present invention there is provided a downhole tool comprising:

a body;

a tool function member axially movable relative to the body; and a fluid pressure actuated member operatively associated with the tool function member and including restriction means for restricting fluid flow through the body, said restriction means being movable between a first configuration, in which said means presents a minimal flow restriction, and a flow restricting second configuration, whereby in said second configuration said means facilitates movement of the fluid actuated member and actuation of said tool function member.

This aspect of the invention facilitates operation of fluid pressure actuated tools, in that the restriction means may be configured to restrict fluid flow and thus allow a relatively modest fluid flowrate to create a significant fluid pressure force. When it is not desired to actuate the member the restriction means is positioned in the first configuration, and thus does not create a significant restriction or barrier to flow through or past the tool.

Preferably, the restriction means includes one or more flaps which may be selectively extended and retracted. Most preferably, in a first configuration the flaps extend radially inwardly to restrict flow through a tool bore.

BRIEF DESCRIPTION OF THE DRAWINGS

This aspect of the invention may be provided independently of or in combination with one or more of the previously described aspects of the invention.

These and other aspects of the present invention will now be described, by way of example, with reference to the accompanying drawings, in which.

DETAILED DESCRIPTION OF THE REFERRED EMBODIMENTS

Figure 1:
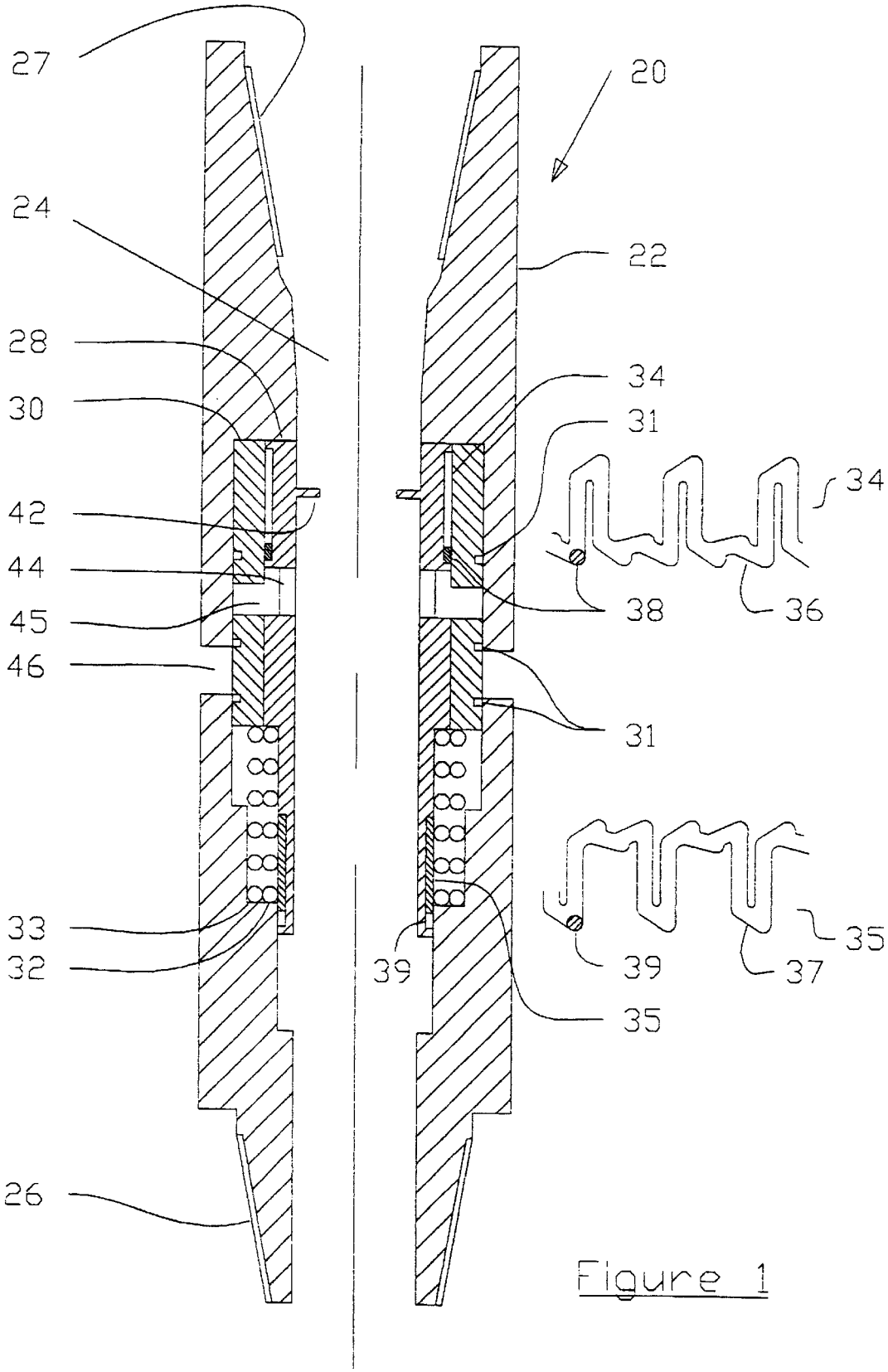
FIG. 1 is a diagrammatic sectional view of a bypass tool in accordance with an embodiment of the present invention, and illustrating track and follower configurations of the tool.

Reference is first made to FIG. 1 of the drawings which illustrates a bypass tool 20 in accordance with an embodiment of the present invention. The tool has a tubular body 22 defining a through bore 24, the ends of the body 22 being provided with conventional pin and box connections 26, 27 to allow the tool 20 to form part of a drill string formed of sections of drill pipe.

The tool 20 further comprises a fluid pressure actuated member in the form of an inner sleeve 28 which is axially movable relative to the body 22. Mounted externally of the sleeve 28 is a tool function member in the form of an outer valve sleeve 30, also axially movable relative to the body 22 and with seals 31 between the sleeve 30 and the body 22. The sleeve 30 is mounted such that it cannot rotate relative to the body 22. Both sleeves 28, 30 are biased upwardly within the body by respective springs 32, 33. The movement of the sleeves 28, 30 relative to the body 22 and relative to one another is controlled by two track and follower arrangements 34, 35, details of which are shown in FIG. 1. The upper track 36 is defined in an outer surface portion of the inner sleeve 28 and extends around the circumference of the sleeve 28. The lower track 37 is defined by a collar rotatably mounted to the lower end of the sleeve 28. The tracks 36, 37 are mirror images of one another. A follower 38 extending radially inwardly from an upper portion of the outer sleeve 30 engages with the upper track 36, while a follower 39 extending inwardly of the body 22 engages with the lower track 37.

The inner sleeve 28 defines a through bore, of corresponding diameter to the body bore 24, and is provided with a flow restriction 42 such that, above a certain flowrate, a pressure differential is created across the restriction 42 to produce a downward acting pressure force on the sleeve 28 sufficient to overcome the action of the spring 32. As will be described, in certain tool configurations, a pressure differential may also be produced sufficient to compress the heavier outer sleeve spring 33.

The inner sleeve 28 is slotted at 44. The valve sleeve 30 and the body 22 each define radially extending flow ports 45, 46. Initially, the sleeve ports 45 are not aligned with the body ports 46. As will be described below, when the ports 45, 46 are aligned the tool provides for mud bypass, that is rather than all of the mud travelling down through the drill string and exiting at nozzles in the drill bit before passing up through the annulus, most of the mud passes directly from the string bore into the annulus, which may be useful in ensuring entrainment of drill cuttings. As will be described below, the track and follower arrangements 34, 35 are arranged such that the ports 45, 46 are only aligned after a predetermined sequence of pressure cycles, and after application of pressure forces above a predetermined level at a certain point on the cycle, and once opened the ports 45, 46 remain aligned until application of further pressure cycles above a predetermined level.

Figure 4:
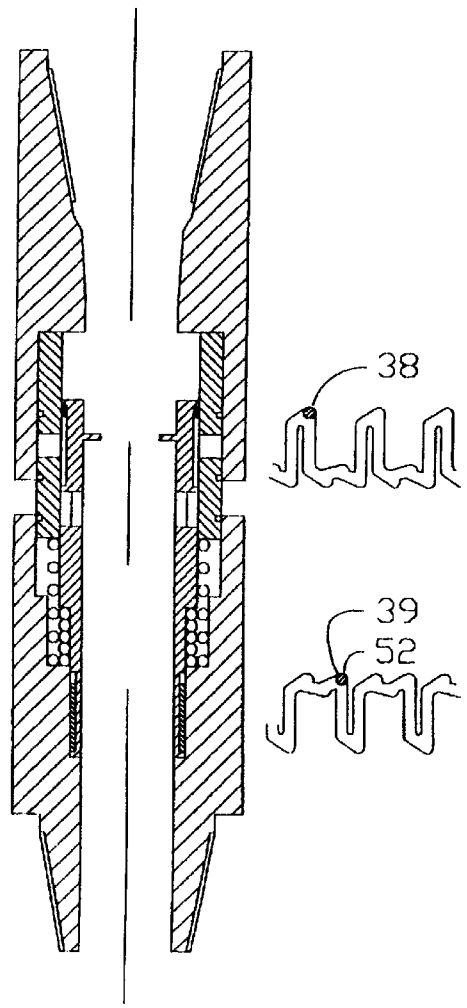
FIGS. 2 to 13 are diagrammatic sectional views of the tool of FIG. 1 in different, sequential configurations.
Figure 3:
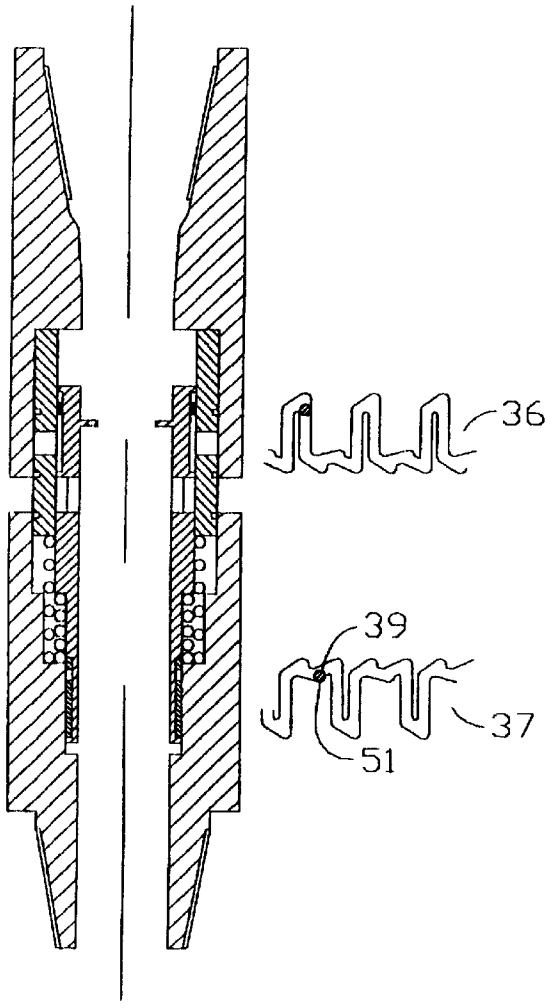
Figure 2:
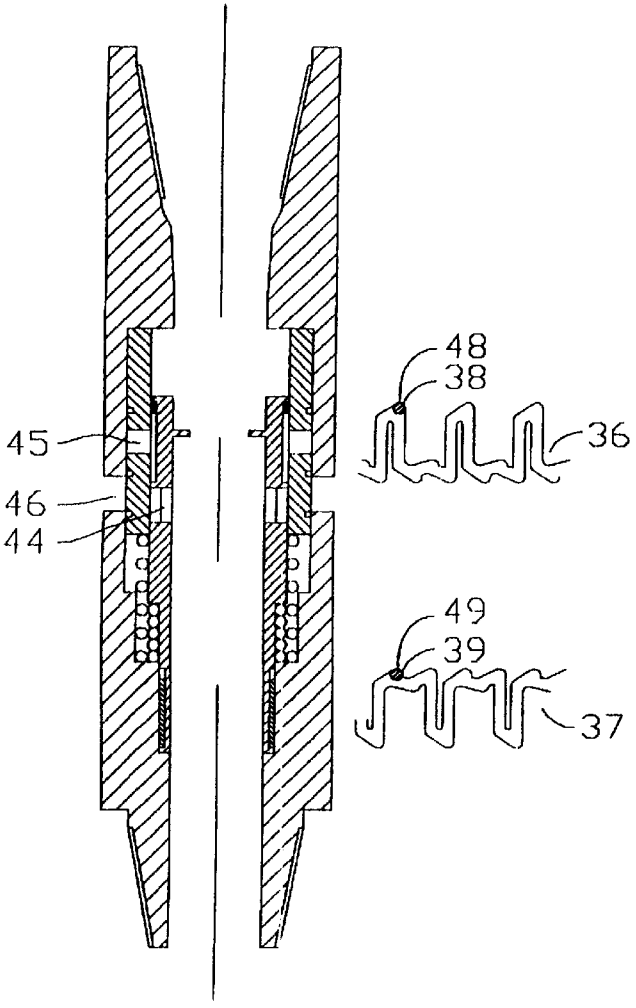

FIG. 1 illustrates the tool in an initial configuration and in which configuration the tool will remain as long as mud flow through the tool remains below a predetermined level, in this example 400 gallons per minute (gpm). If the mud flow is increased to more than 400 gpm, the pressure force created across the flow restriction 42 is sufficient to compress the spring 32, such that the inner sleeve 28 is moved downwardly relative to the body 22 and outer sleeve 30. The track followers 38, 39 travel along the respective tracks 36, 37. The configuration of the track 36 is such that the relative axial movement between the follower 38 and the track 36 results in rotational movement of the inner sleeve 28 which moves downwardly in the body 22 until the followers 38, 39 engage respective track stops 48, 49. In this position, as illustrated in FIG. 2 of the drawings, the outer sleeve ports 45 remain out of alignment with the body parts 46 and there is no fluid communication between the body bore 24 and the surrounding annulus. The inner sleeve 28 remains in the lower position until the mud flow is reduced to less than 400 gpm, which allows for partial extension of the spring 32, until the follower 39 engages the next stop 51 on the track 37, as illustrated in FIG. 3 of the drawings. In this position, the flow ports 45, 46 remain misaligned. It will also be evident from FIG. 3 that the collar defining the track 37 has rotated relative to the body 22 to accommodate this relative positioning of the sleeves and body. On increasing the mud flowrate to above 400 gpm, the upper follower 38 is brought back into contact with the stop 48 and the lower follower 39 into contact with a further stop 52, as illustrated in FIG. 4 of the drawings.

Figure 5:
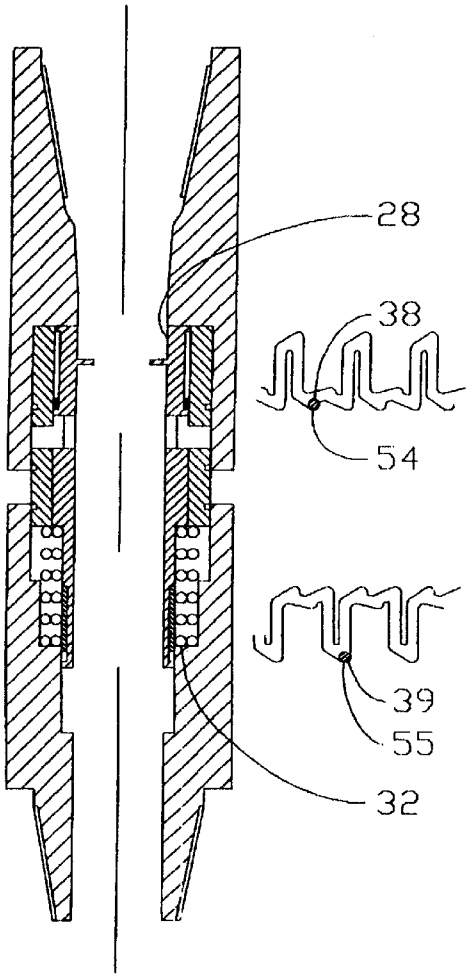
Figure 10:
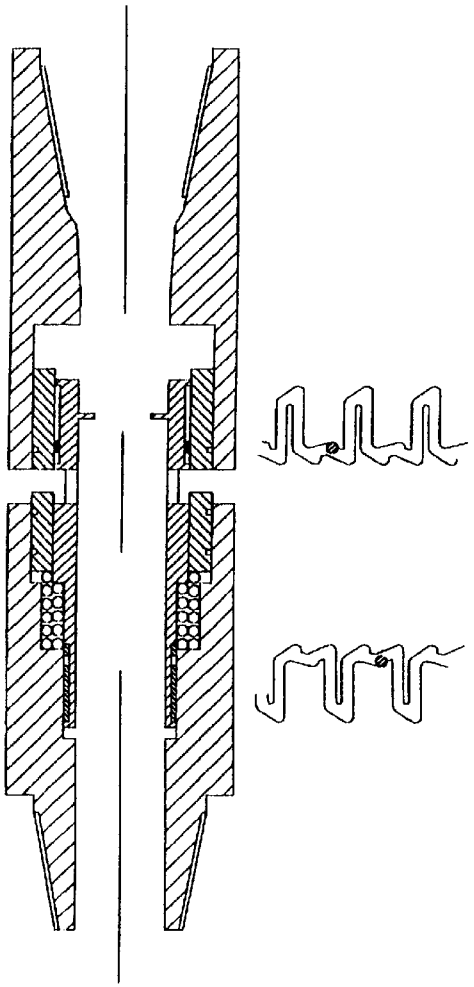

When the mud flow is reduced once more below 400 gpm, the spring 32 lifts the inner sleeve 28 such that the sleeve 28 returns to its initial position, and the upper follower 38 engages the track stop 54 and the lower follower 39 engages the track stop 55, as illustrated in FIG. 5 of the drawings.

Figure 7:
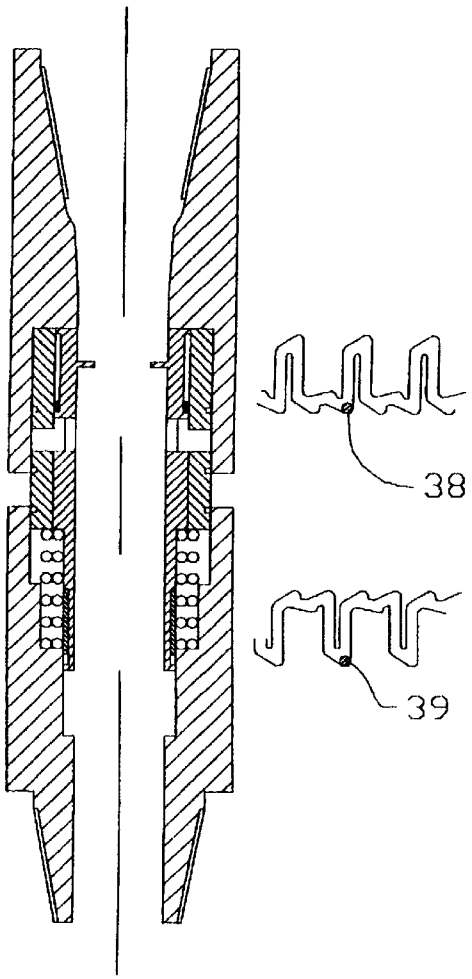

If the mud flow is then increased to a flow between 400 and 600 gpm, downward movement of the sleeve 28 is arrested by the upper follower 38 engaging the track stop 56, that is the outer sleeve 30, and in particular the outer sleeve return spring 33, prevents further downward axial movement of the inner sleeve 28. In this example the spring 33 is selected such that, as long as the mud flow remains below 600 gpm, the outer sleeve 30 will not move downwards. If the mud flowrate is reduced once more, the spring 32 lifts the inner sleeve 28 and the followers 38, 39 advance to a position on the respective tracks 36, 37, as illustrated in FIG. 7, corresponding to the initial position as illustrated in FIG. 1. Thus, as long as the mud flow does not exceed 600 gpm while the sleeves 28, 30 are in the relative positions as illustrated in FIG. 6 of the drawings, the ports 45, 46 will remain misaligned, and there will be no mud flow through the body ports 46.

Figure 6:
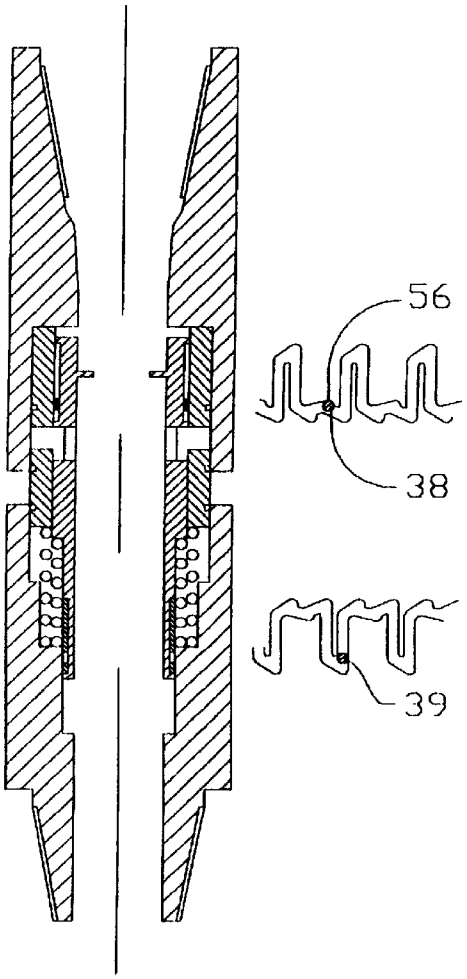

If it is desired to provide bypass, mud flow is increased above 600 gpm when the sleeves 28, 30 are in the relative positions as illustrated in FIGS. 5 and 6 of the drawings, as will be described with reference to FIGS. 9 to 13 of the drawings.

Figure 9:
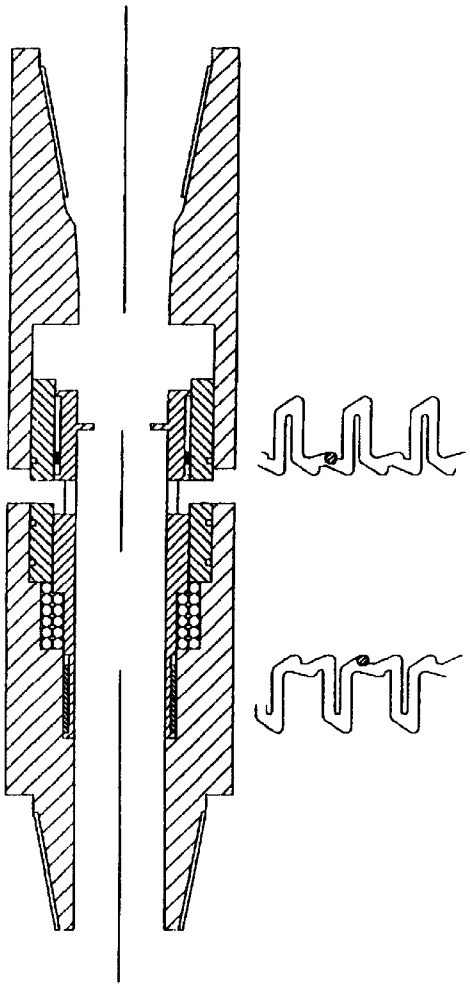
Figure 8:
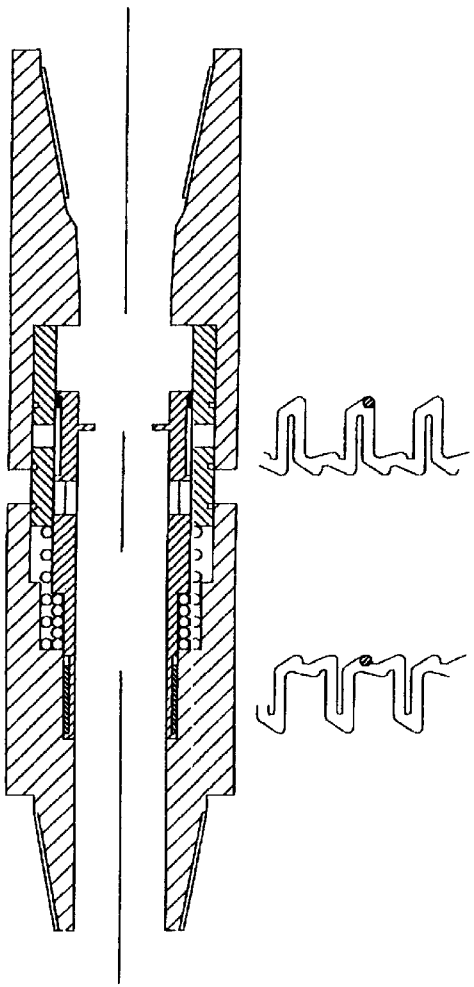
Figure 13:
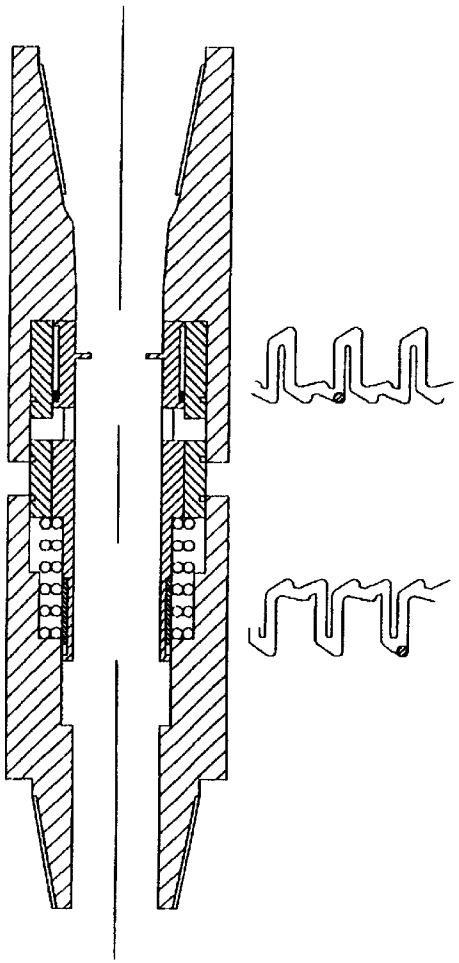
Figure 12:
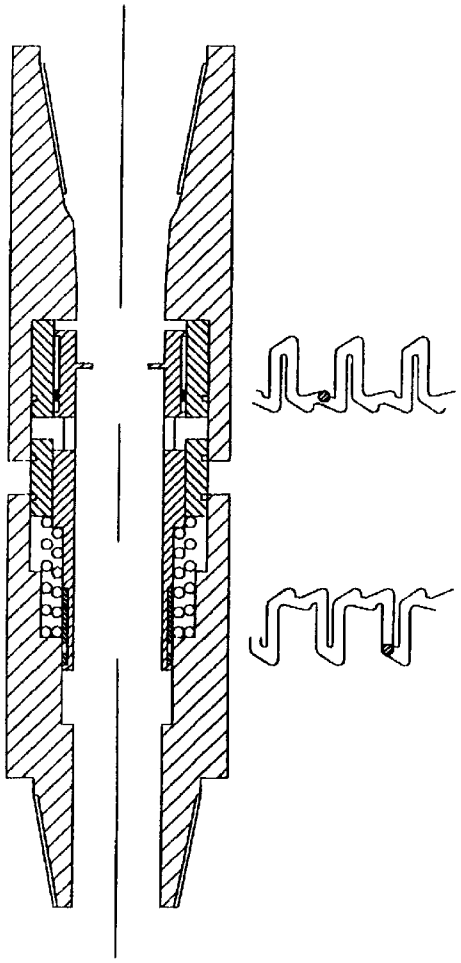
Figure 11:
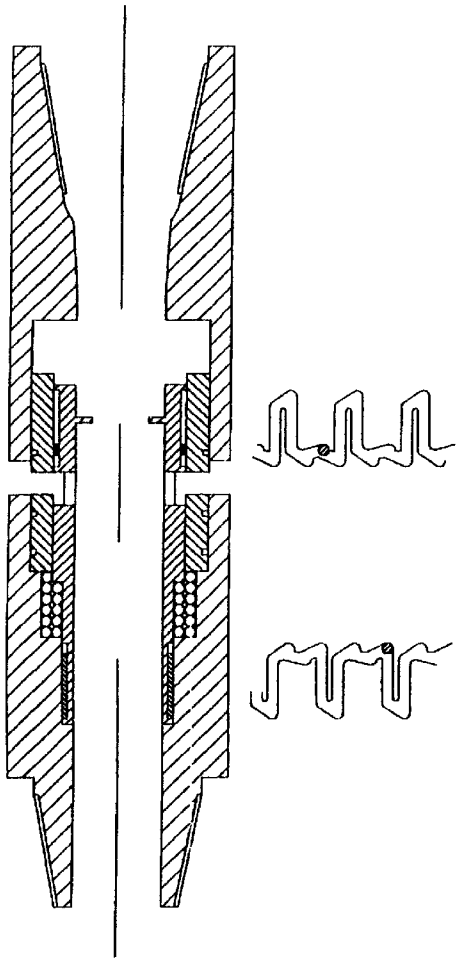

Reference is first made to FIG. 9, which illustrates the relative positions of the sleeves 28, 30 and the body 22 when, starting from the relative positions as illustrated in FIG. 5, mud flow has been increased to greater than 600 gpm. Accordingly, the pressure force acting on the inner sleeve 28 across the flow restriction 42 has not only compressed the spring 32 but has also compressed the spring 33 such that the ports 45, 46 are aligned. Once this relative positioning of the sleeves 28, 30 and body 22 has been achieved, the track configurations are arranged such that the ports 45, 46 remain aligned if the mud flow is reduced below 600 gpm (see FIG. 10) and then increased above 600 gpm once more (see FIG. 11). However, if the flow is then reduced to below 400 and 600 gpm the spring 33 lifts the outer sleeve 30 to close the port 46, as illustrated in FIG. 12. If flow is then further reduced below 400 gpm, the followers 38, 39 assume the positions on the respective tracks, 36, 37 corresponding to the initial position as illustrated in FIGS. 1 and 7.

From the above description it will be apparent to those of skill in the art that the tool 20 described above offers many advantages over convention bypass tools. In particular, the configuration of the tool 20 is such that, as long as the pump flowrate remains below a predetermined level at selected points during the pressure cycle, the tool 20 may be subject to an indefinite number of cycles without opening. However, if it is desired to open the tool 20, all that is required is for the mud flowrate to be varied and, at a certain point, to be increased above a predetermined flowrate, in this example 600 gpm. Further, once the tool 20 has been opened the tool will remain open through a predetermined number of further pressure cycles (below 600 gpm, above 600 gpm below 600 gpm). Of course, if it is necessary to increase the mud flowrate above 600 gpm, but it is not desired to open the tool 20 at this point, it is merely necessary to ensure that the inner sleeve 28 is not being supported by the outer sleeve 30 at this point and may move independently of the sleeve 30.

Figure 14:
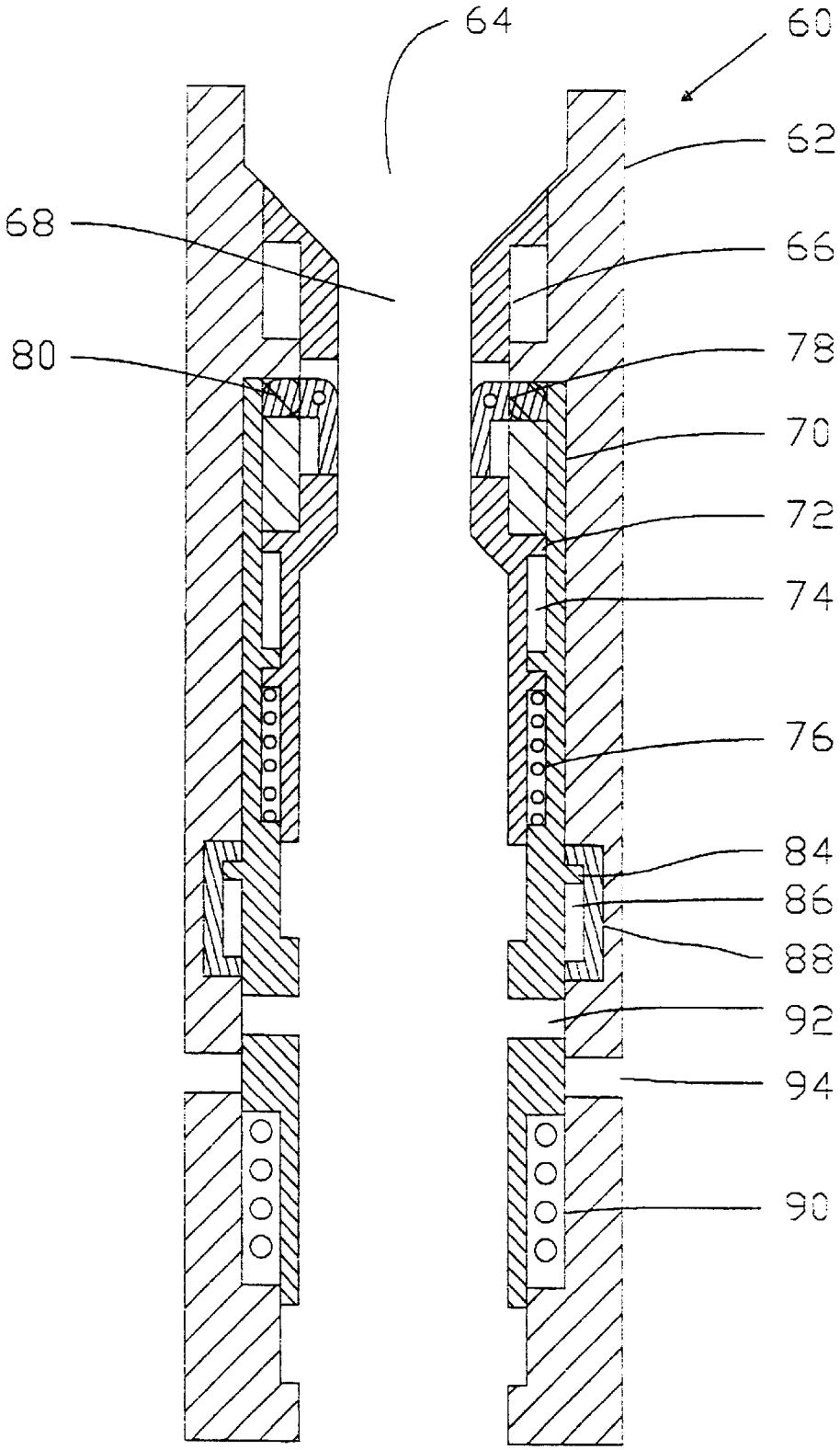
FIG. 14 is a diagrammatic sectional view of a bypass tool in accordance with a preferred embodiment of the present invention.

Reference is now made to FIGS. 14 to 29 of the drawings, which illustrate a bypass tool 60 in accordance with a preferred embodiment of the present invention. Reference is first made in particular to FIG. 14 of the drawings, which illustrates the main features of the tool 60; those of skill in the art will realise that this and the other drawings are diagrammatic, with a view to facilitating understanding of the operation of the tool.

The tool 60 has a tubular body 62 defining a through bore 64, the ends of the body 62 being configured to allow the tool 60 to form part of a drill string formed of sections of drill pipe. The tool 60 further comprises an actuator sleeve 66 which defines a bore restriction 68 allowing a pressure force to be applied to the sleeve 66 by passing fluid through the body bore 64. Also mounted on the body 62 is a bypass sleeve 70 which is selectively coupled to the actuator sleeve 66, as will be described.

Figure 15:
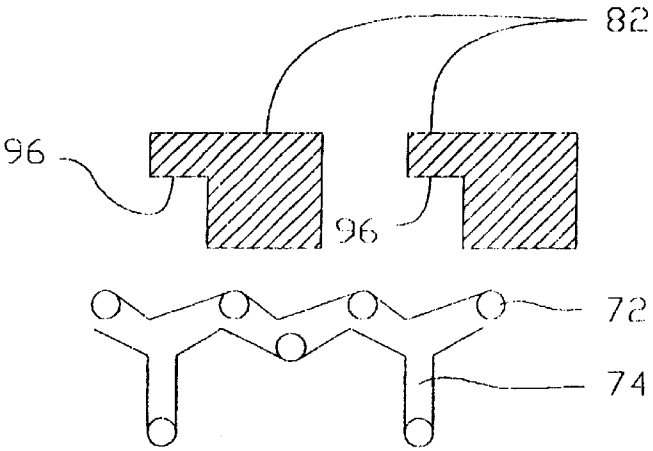
FIG. 15 is a diagrammatic representation of an actuating sleeve groove, and pins and protrusions on an inner face of a bypass sleeve of the tool of FIG. 14.

The actuator sleeve 66 is axially movable and rotatable relative to the body 62, movement of the sleeve 66 being controlled by pins 72 which engage with a groove or track 74 defined by an inner face of the bypass sleeve, a track 74 and a number of pin locations being illustrated in FIG. 15 of the drawings (it should be noted that in FIGS. 16 to 29 the bypass sleeve 70 appears to be rotating while the actuator sleeve 66 does not appear to rotate; the tool is illustrated in this manner to facilitate understanding of the tool operation). Also, the actuator sleeve 66 is biassed upwardly relative to the bypass sleeve 70 by an actuator spring 76 located below the track 74.

Mounted in the portion of the actuator sleeve defining the bore restriction 68 are flaps 78 which, as will be described, may be extended into the body bore 64 to restrict fluid flow through the body 62, and allow application of significant fluid pressure forces to the sleeve 66. The flaps 78 are pivotally mounted to the sleeve 66 and the configuration of the flaps is controlled by the interaction of flap extensions 80 with profiled protrusions 82 on the bypass sleeve 70, as illustrated in FIG. 15 of the drawings.

The bypass sleeve 70 is axially movable relative to the body 62, the movement of the sleeve 70 being controlled by the interaction of pins 84 extending radially outwardly of the sleeve 70 and engaging a track 86 on a hold-down sleeve 88 rotatably mounted in the body 62. A heavy spring 90 is provided between the bypass sleeve 70 and the body 62 and tends to urge the sleeve 70 upwardly relatively to the body 62. Although not illustrated, another pin extends from the sleeve 70 to engage an axial slot in the body 62, to prevent rotation of the sleeve 70 relative to the body 62.

To allow fluid bypass, that is for fluid to flow directly from the body bore 64 into the annulus, without passing downwardly and through the drill bit, the bypass sleeve 70 defines ports 92 which, as will be described, may be selectively aligned with corresponding ports 94 in the body 62.

Figure 17:
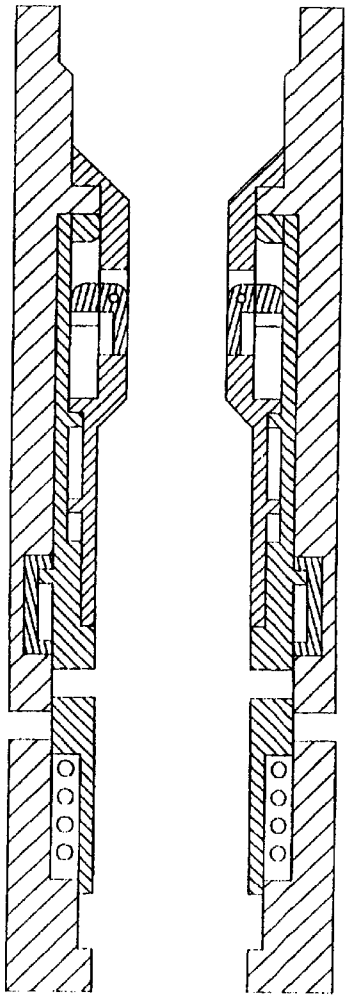
FIGS. 16 to 29 are diagrammatic sectional views of the tool of FIG. 14 in different, sequential configurations.
Figure 16:
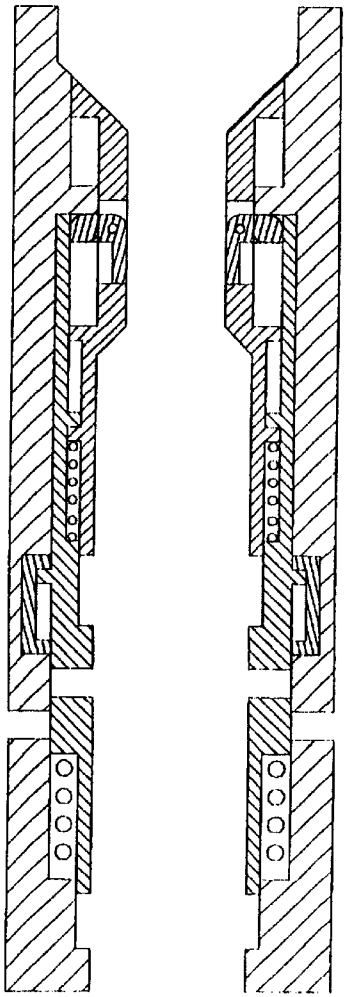
Figure 20:
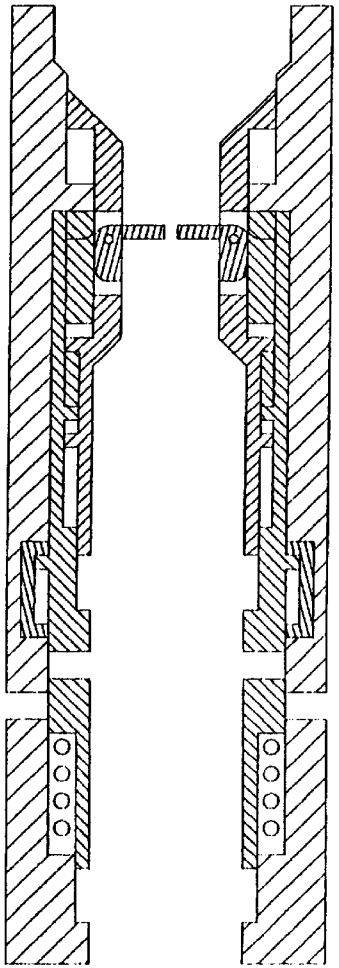
Figure 19:
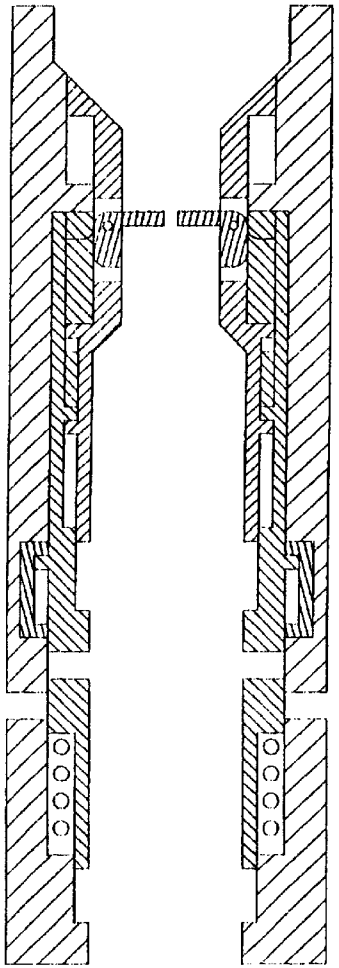
Figure 18:
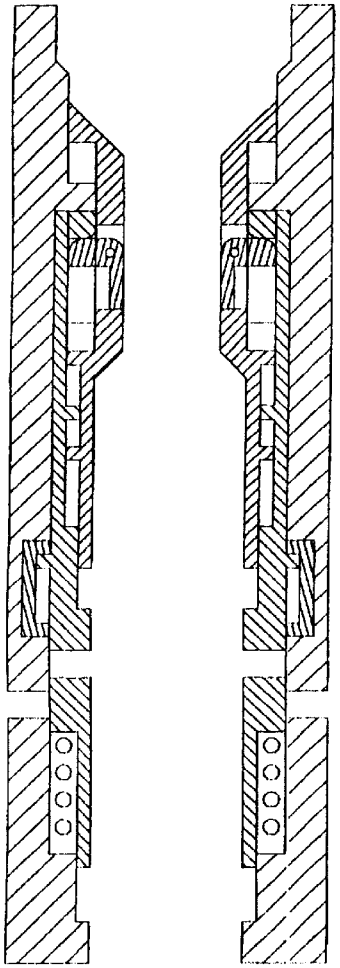

The operation of the tool 60 will now be described with reference to FIGS. 16 through 29 of the drawings. FIG. 16 illustrates the tool 60 in an initial or start position, with both the actuator sleeve 66 and the bypass sleeve 70 biassed toward upper positions by the respective sleeve springs 76, 90. On the mud pumps at the surface being turned on to full flow the actuator sleeve 66 is moved downwardly by the pressure force created by the fluid passing through the bore restriction 68. The interaction of the pins 72 and the track 74 cause the sleeve 66 to rotate relative to the body 62 and the bypass sleeve 70 as the sleeve 66 moves axially downwards, to the position as illustrated in FIG. 17. If the pumps are then turned off, the actuator sleeve 66 moves upwardly, and rotates, and as the sleeve 66 moves upwardly the flap extensions 80 contact faces 96 of the protrusion 82, to extend the flaps 78, as shown in FIGS. 18 and 19. If the mud pumps are then turned on and pump slowly up to a first predetermined pressure (X) the actuator sleeve 66 moves downwards slightly and rotates, to the position as illustrated in FIG. 20. If the pumps are then turned off, the actuator sleeve 66 moves upwardly again, rotates, and the flaps 78 fall open, as illustrated in FIG. 16.

By cycling the tool 60 as described above, it will be noted that there is no movement of the bypass sleeve 70, such that the ports 92, 94 remain mis-aligned. The procedure to open the ports 92, 94 is described below.

Figure 21:
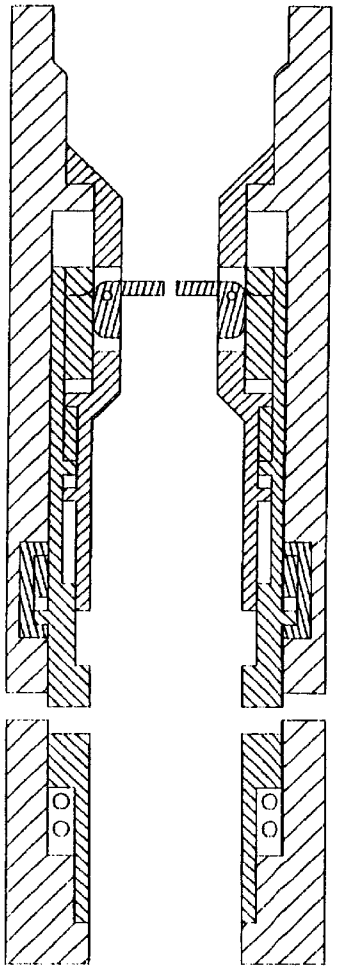
Figure 24:
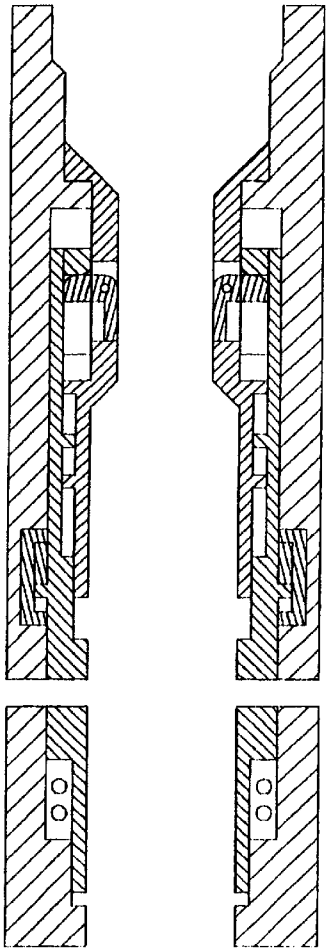
Figure 23:
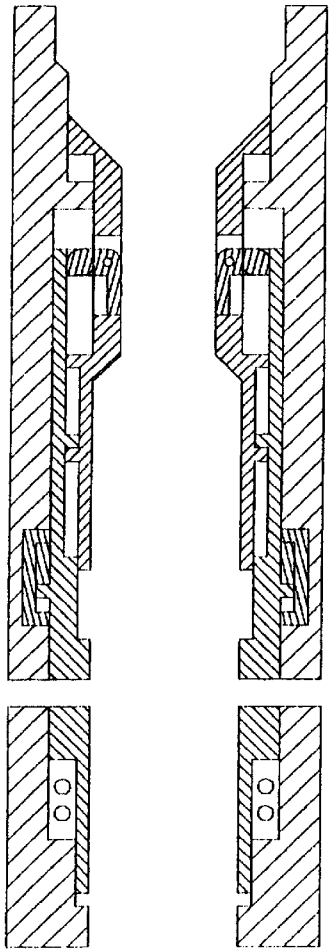
Figure 22:
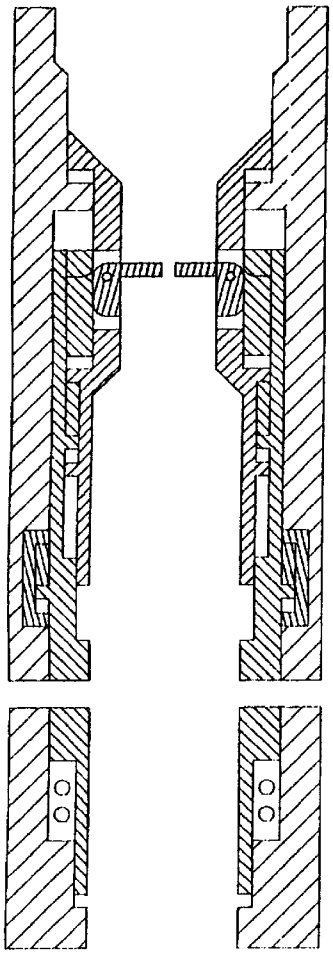

The initial movement of the actuator sleeve 66 is as described above, that is from the start position shown in FIG. 16 the pumps are turned on full to move the actuator sleeve 66 down and also rotate the sleeve 66 to the position as shown in FIG. 17. The pumps are then turned off, allowing the sleeve 66 to move upwardly and rotate and to extend the flaps, as illustrated in FIGS. 18 and 19. However, on turning on the pumps slowly again, the pressure produced by the pumps is increased to a higher second predetermined level (X+Y), which additional pressure also allows the bypass sleeve 70 to be moved downwardly, against the spring 90, by the action of the pins 72 on the bypass sleeve track 74. This position is illustrated in FIG. 21 of the drawings. On turning the pumps off, the bypass sleeve 70 moves partially upwards, restrained by the hold-down sleeve 88, which has rotated relative to the bypass sleeve 70, and the actuator sleeve 66 moves upwardly and rotates relative to the bypass sleeve 70, allowing the flaps 78 to fall open, as illustrated in FIGS. 22 and 23 of the drawings. The pumps may now be turned on fully, which causes the actuator sleeves 66 to move downwardly and rotate, and in which position the ports 92, 94 are aligned such that the majority of fluid flow is directed from the body bore 64, through the ports 92, 94, and into the annulus, as shown in FIG. 24.

Figure 25:
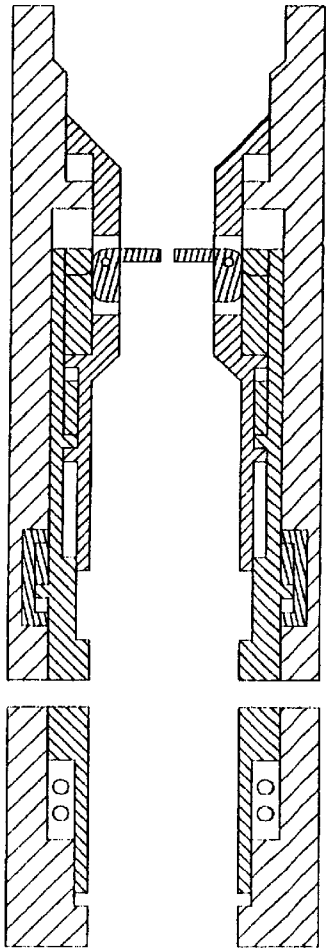
Figure 29:
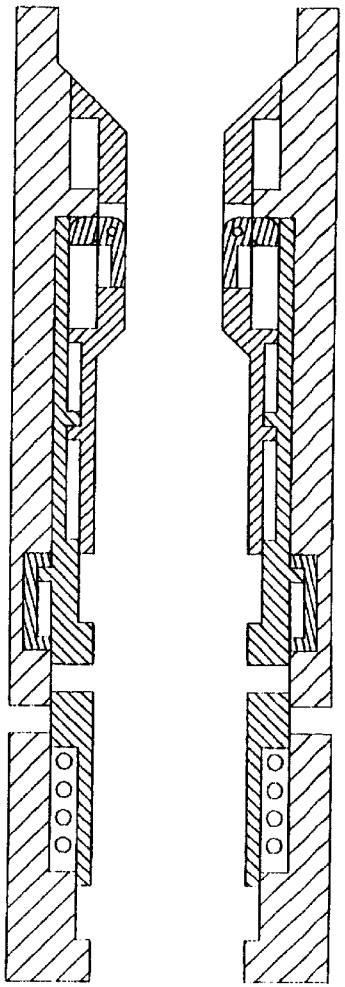
Figure 28:
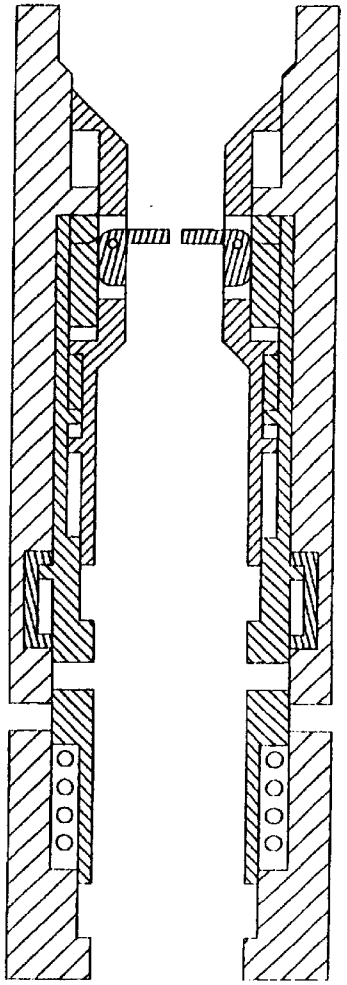
Figure 27:
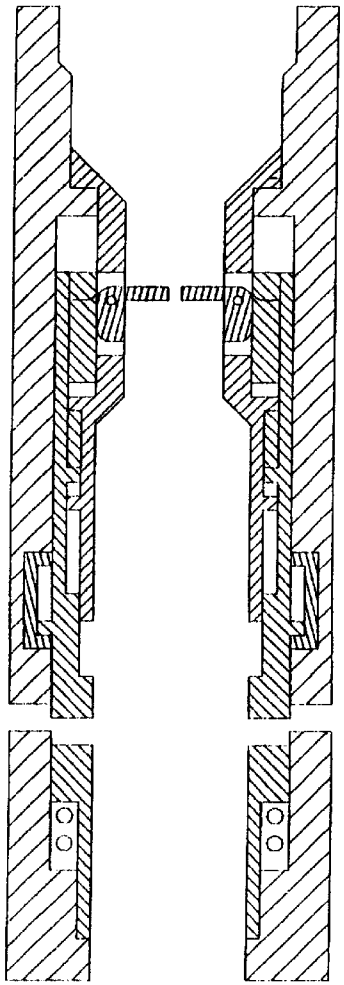
Figure 26:
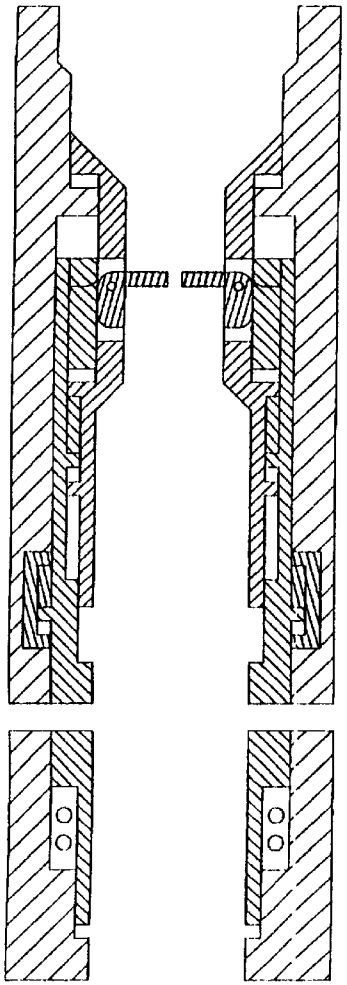

On turning the pumps off, the actuator sleeve 66 moves upwardly, rotates relative to the bypass sleeve 70, and the flap extensions 80 engage with the bypass sleeve protrusions 82 to extend the flaps 78, as shown in FIG. 25 of the drawings. By then turning the pumps on slowly to achieve the higher second predetermined pressure (X+Y) above the closed flaps 78, the actuator sleeve 66 is moved downward partially, rotating relative to the bypass sleeve 70, and latterly in the downward stroke taking the bypass sleeve 70 fully downwardly, as illustrated in FIGS. 26 and 27 of the drawings. When the pumps are turned off again, the actuator sleeve 66 moves upwardly, rotating relative to the bypass sleeve 70 and body 62, such that the flaps 78 are retracted and the bypass sleeve 70 returns to the initial position, with the ports 92, 94 mis-aligned, as illustrated in FIGS. 28 and 29 of the drawings.

From the above description it will be apparent that this embodiment of the invention offers significant advantages by the provision of the retractable restriction in the form of the flaps 78. In tools provided with a fixed permanent restriction, such as a nozzle, a permanent bore restriction is introduced into the string, thus restricting drilling mud flow rates. Further, the axial force which may be applied via a fixed nozzle is limited to typically around 1,000 pounds (minus friction and any spring force that must be overcome).

With this embodiment of the present invention, extension of the flaps 78 creates a significant restriction in the bore, and it is estimated that a force in the region of 50,000 pounds would be available from a typical tool. A further advantage provided by the significant restriction created in the tool bore by the extended flaps 78, is that the tool may be functioned at very low mud circulating rates. In the illustrated example, this greatly extends the life of the seals around the ports 92, 94, due to the minimal flow across the seals as the tool is opening. Also, the provision of the flaps 78 allows the configuration of the tool to be determined from surface, from the high pressure that is produced at the relatively low flow rates, without functioning the tool. When the flaps are opened, losses are minimal due to the relatively modest bore restriction which is required to allow movement of the actuator sleeve 66.

Figure 30:
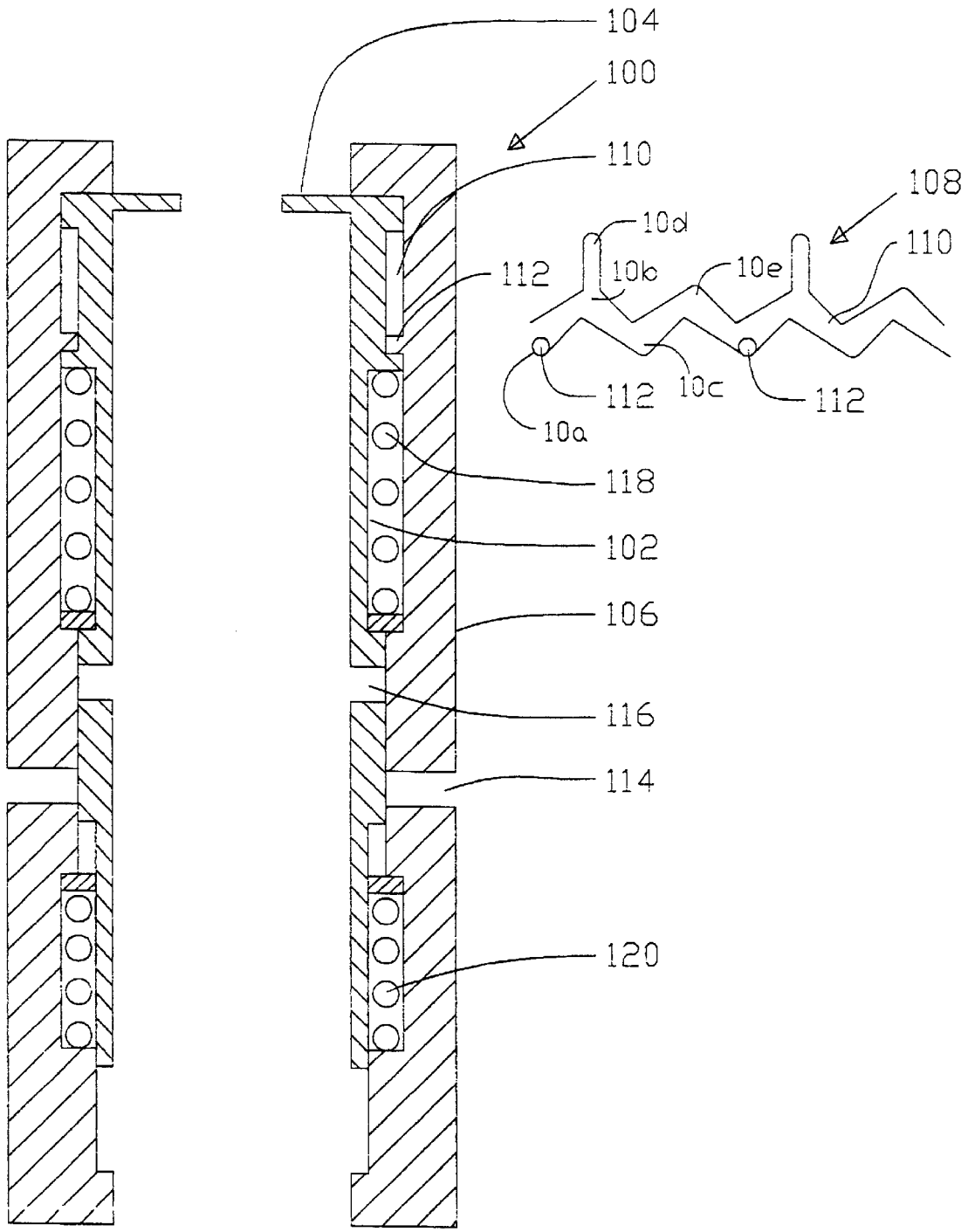
FIG. 30 is a diagrammatic sectional view of a bypass tool, including an illustration of the track and follower configuration of the tool, in accordance with another embodiment of the invention.

Reference is now made to FIG. 30 of the drawings, which illustrates a bypass tool 100 in accordance with another embodiment of the invention. The tool 100 represents a less sophisticated embodiment of the invention, comprising a one-piece sleeve 102 defining a fixed flow restriction 104. The sleeve 102 is axially and rotatably movable within a tubular body 106, movement of the sleeve 102 being controlled by a track and follower arrangement 108; the track 110 is defined in an upper outer surface of the sleeve 102 and the follower 112 is in the form of pins extending radially inwardly from the body 106. As will be described, the sleeve 102 is movable between a "closed" position (as illustrated) in which flow ports 114 in the body are closed by the sleeve 102, and an open or flow position in which sleeve ports 116 are aligned with the body ports 114, allowing fluid to flow from the tool bore directly into the surrounding annulus.

The provision of the restriction 104 renders the sleeve 102 flow sensitive, that is the greater the fluid flow rate through the string of which the tool forms a part, the greater the differential pressure acting across the restriction 104, and the greater the axial force acting on the sleeve 102. Axial movement of the sleeve 102 towards the open or flow position is resisted by a pair of springs 118, 120 acting between the body 106 and the sleeve 102. The first spring 118 constantly urges the sleeve 102 upwardly, while the higher rated second spring 120 only acts on the sleeve 102 during certain points in the cycling of the sleeve 102, as described below.

FIGS. 30 illustrates the tool in the position where there is little or no flow through the tool 100, such that the spring 118 biases the sleeve 102 upwardly to its fullest extent, the pin followers 112 occupying the lowermost stop 110*a* on the track 110. An increase in mud flow rate will push the sleeve 102 downwards, against the action of the spring 118, this axial movement being accompanied by rotation of the sleeve 102 such that the pin followers 112 will move to the stop 110*b* on the track 110. At this position the sleeve and body ports 116, 114 remain misaligned. Further axial movement of the sleeve 102 requires that the second spring 120 is compressed, this requiring an elevated mud flow rate. In the absence of such an elevated flow rate the ports 116, 114 remain misaligned, and on the mud flow rate reducing the sleeve 102 is returned to the position as illustrated in FIG. 30, but with the pin followers 112 at stop 110*c* in the track 110. If however, the rate of flow is increased to an elevated level sufficient to compress the spring 120, the pin followers 112 will move into the longer slots 110*d* in the track, allowing the sleeve 102 to move downwardly and the ports 116, 114 to come into alignment. A subsequent reduction in flow rate will return the followers 112 to stops 110*c* on the track 110.

A subsequent increase in mud flow rate will move the sleeve 102 and bring the pin followers 112 into contact with the stops 110*e;* in this position the sleeve 102 is restrained from further downward movement, whatever the pressure differential across the restriction 104.

It will be apparent that the tool 100 may be cycled indefinitely and will only "open" when an elevated mud flow is provided at a particular part of the cycle; the drilling operators need not spend time cycling the tool in order to close the tool as a result of the normal variations in mud flow experienced during a drilling operation.

Figure 31:
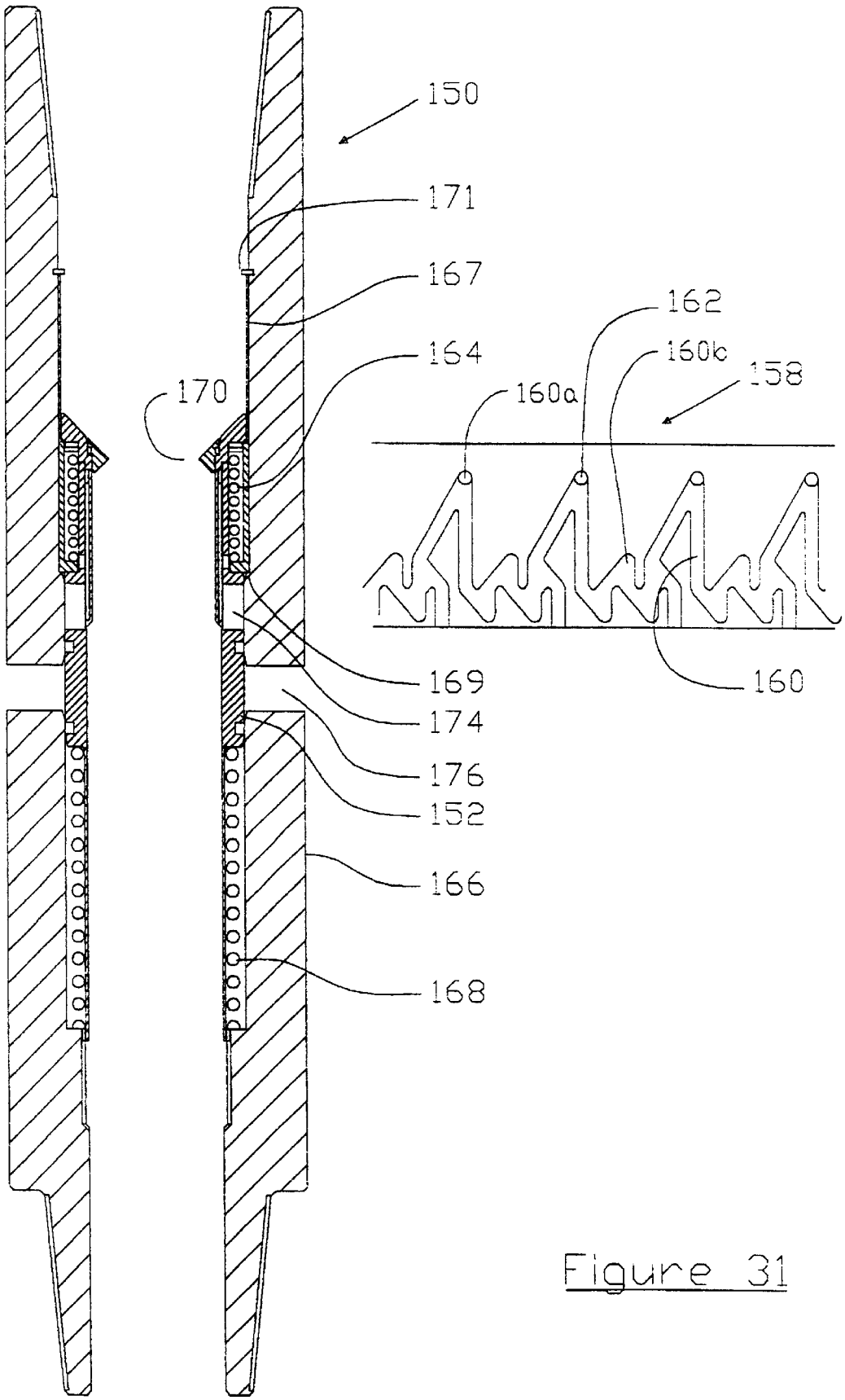
FIG. 31 is a sectional view of a bypass tool, including an illustration of the track and follower configuration of the tool, in accordance with a further embodiment of the invention.
Figure 32:
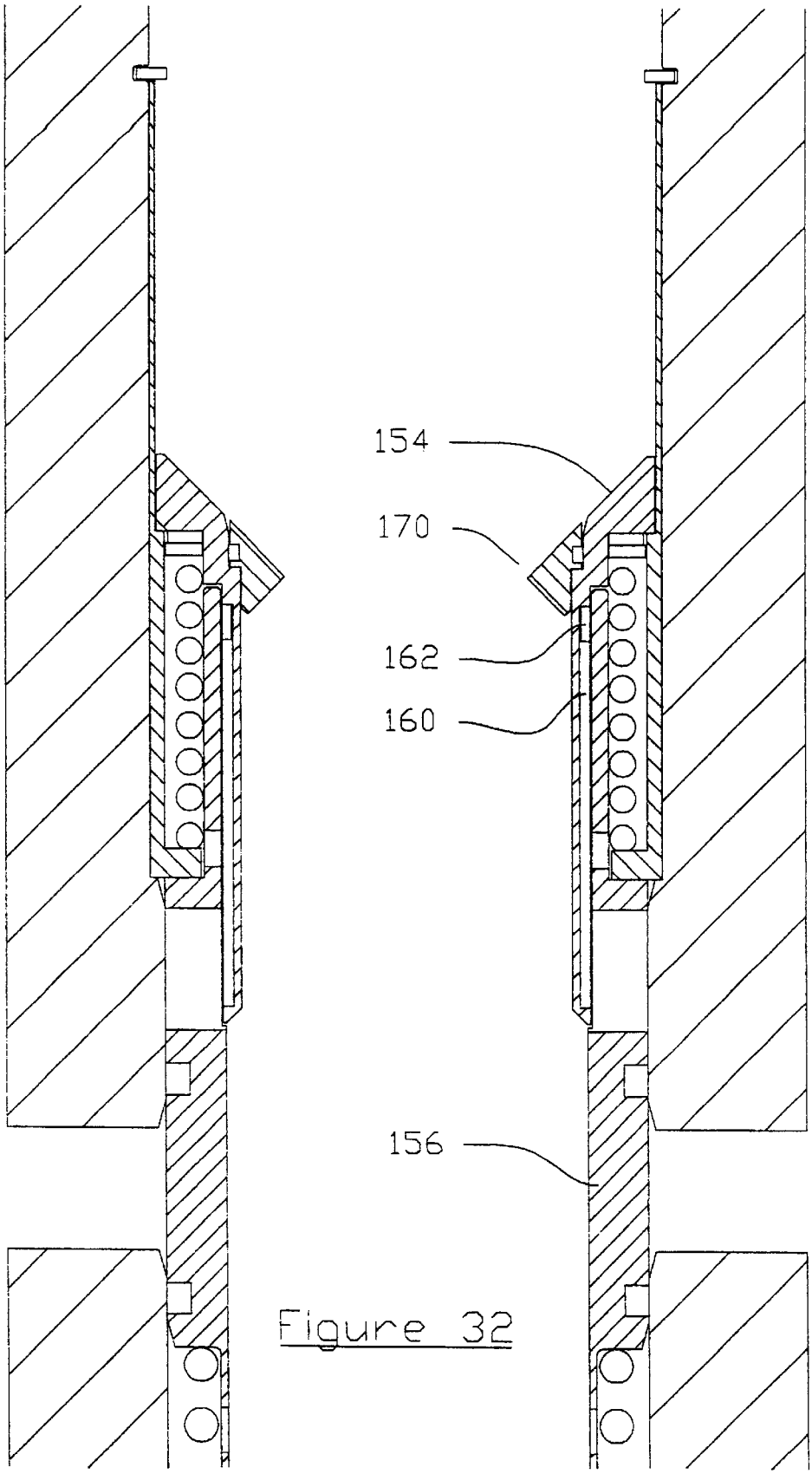
FIG. 32 is an enlarged view of part of the tool of FIG. 31.

Reference is now made to FIGS. 31 and 32 of the drawings, which illustrate a bypass tool 150 in accordance with another embodiment of the invention. This tool 150 features a two-part sleeve 152, the parts of the sleeve 154, 156, being selectively coupled by a track and follower arrangement 158 as illustrated in FIG. 31, the track 160 being defined by on outer face of the first sleeve 154 and pin followers 162 being provided on an upper inner portion of the second sleeve 156.

Movement of the sleeves 154 , 156 is controlled by the track and follower arrangement 158 in conjunction with a relatively light first spring 164 between the first sleeve 154 and the tool body 166 and pre-tensioned heavier second spring 168 between the second sleeve 156 and the body 166. The first spring 164 is mounted to the body 166 via a spacer sleeve 167 retained in the body between a shoulder 169 and a circlip 171.

The first sleeve 154 defines a restriction 170 such that the flow of mud through the tool 150 creates an axial pressure force on the sleeve 154; the sleeve 154 is illustrated in the position it would assume under full flow, with the location of the followers 162 in the track 160*a* allowing the sleeve 154 to be moved to its maximum extent without such movement being transferred to the other sleeve 156. However, it will be apparent that by cycling the mud flow it is possible to locate the followers 162 against stops 160*b* which will allow the sleeve 154 to transfer force to the second sleeve 156 and, if the mud flow rate is sufficient, move the second sleeve 156 downwardly to open the tool by aligning the ports in the sleeve 174 with the ports in the body 176.

It will be apparent to those of skill in the art that the above-described embodiments are merely exemplary of the present invention, and that various modifications and improvements may be made thereto, without departing from the scope of the invention.

What is claimed is:

1. A downhole tool comprising:

a body;

a tool function member axially movable relative to the body from an initial position to an operative position;

first means responsive to a first force for permitting movement of the tool function member from the initial position to an intermediate position; and second means responsive to a higher second force for selectively permitting movement of the tool function member to the operative position.

2. The tool of claim 1, wherein the tool function member is fluid pressure actuated and the first means is responsive to a first fluid pressure force and the second means is responsive to a higher second fluid pressure force.

3. The tool of claim 2, wherein the tool function member is actuated by flow induced fluid pressure forces.

4. The tool of claim 3, wherein the tool function member is operatively associated with a flow restriction.

5. The tool of claim 4, wherein the flow restriction is fixed.

6. The tool of claim 4, wherein the flow restriction is variable.

7. The tool of claim 6, wherein the flow restriction is movable between a first configuration, in which said restriction presents a minimal flow restriction, and a flow restricting second configuration, and wherein, in said second configuration, said restriction facilitates actuation of said tool function member.

8. The tool of claim 7, wherein the flow restriction includes at least one selectively extendable and retractable flap.

9. The tool of claim 8, wherein, in a first configuration, the at least one flap extends radially inwardly to restrict flow through a tool bore.

10. The tool of claim 1, wherein each of the first and second means is a spring.

11. The tool of claim 10, wherein each of the first and second means is a pair of springs, a first of said pair of springs permitting movement of the member to the intermediate position and a second of said pair of springs only permitting movement to the operative position on application of the higher second fluid pressure force.

12. The tool of claim 1, wherein the tool function member is rotatable relative to the body.

13. The tool of claim 1, wherein the tool function member is a sleeve.

14. The tool of claim 1, wherein the movement of the tool function member relative to the body is controlled by a track and follower arrangement.

15. The tool of claim 1, wherein the tool function member is in two or more parts, coupled by means for selectively coupling the parts.

16. The tool of claim 1, wherein the tool function member comprises a fluid pressure actuated part axially movable relative to the body, and a tool function part axially movable relative to the body to one or more operative positions, and the tool further comprises means for selectively coupling the fluid pressure actuated part to the tool function part to permit movement of said tool function part to the one or more operative positions.

17. The tool of claim 16, wherein in a first configuration said coupling means permits axial movement of the fluid pressure actuated part substantially independently of the tool function part, and in a second configuration axial movement of the fluid pressure actuated part results in corresponding axial movement of the tool function part.

18. The tool of claim 16, wherein the fluid pressure actuated part is biased towards the initial position by the first means and the tool function part is biassed towards the initial position by said second means.

19. The tool of claim 16, wherein the coupling means comprises a track and follower arrangement configurable to restrict relative movement between the fluid pressure actuated part and the tool function part.

20. The tool of claim 19, wherein the coupling means further comprises a further track and follower arrangement to selectively restrict movement of the fluid pressure actuated part relative to the body.

21. The tool of any of claim 1, wherein the tool is a fluid bypass tool, and in the operative position the tool function member permits fluid flow between a tool bore and a tool exterior.

22. A downhole tool comprising:

a body;

a tool function member axially movable relative to the body; and a fluid pressure actuated member operatively associated with the tool function member and including means for restricting fluid flow through the body, said restriction means being movable between a first configuration, in which said means presents a minimal flow restriction, and a flow restricting second configuration, whereby in said second configuration, said means facilitates movement of the fluid actuated member and actuation of said tool function member.

23. The tool of claim 22, wherein the restriction means includes at least one selectively extendable and retractable flap.

24. The tool of claim 23, wherein in a first configuration the at least one flap extends radially inwardly to restrict flow through a tool bore.

25. A downhole tool comprising:

a body;

a fluid pressure actuated member axially movable relative to the body;

a tool function member which is not responsive to fluid pressure and is axially movable relative to the body to an operative position; and means for selectively coupling the fluid pressure actuated member to the tool function member to permit movement of said tool function member to the operative position.

26. A method of remotely activating a downhole tool, the method comprising:

providing a downhole tool comprising a body, a fluid pressure actuated member axially movable relative to the body and a tool function member which is not responsive to fluid pressure and is axially movable relative to the body;

selectively coupling the fluid pressure actuated member to the tool function member; and applying fluid pressure to said fluid pressure actuated member to move the members axially relative to the body, thereby moving the tool function member to an operative position.

* * * * *